US012685926B2

(12) United States Patent
Kam

(10) Patent No.: US 12,685,926 B2
(45) Date of Patent: Jul. 21, 2026

(54) TOY PROJECTILE HAVING IMPACT HEAD WITH MULTIPLE FLEXIBLE PRONGS

(71) Applicant: Ao Jie Plastic Toys Factory Ltd., Kwun Tong (HK)

(72) Inventor: Chi Hang Kam, Kwun Tong (HK)

(73) Assignee: Ao Jie Plastic Toys Factory Ltd., Kwun Tong (HK)

( * ) Notice: Subject to any disclaimer, the term of this patent is extended or adjusted under 35 U.S.C. 154(b) by 317 days.

(21) Appl. No.: 18/608,865

(22) Filed: Mar. 18, 2024

(65) Prior Publication Data

US 2025/0288901 A1 Sep. 18, 2025

(51) Int. Cl.
*A63F 9/02* (2006.01)

(52) U.S. Cl.
CPC .... *A63F 9/0208* (2013.01); *A63F 2009/0221* (2013.01)

(58) Field of Classification Search
None
See application file for complete search history.

(56) References Cited

U.S. PATENT DOCUMENTS

D931,372 S 9/2021 Zhong

*Primary Examiner* — Sunit Pandya
(74) *Attorney, Agent, or Firm* — LaMorte & Associates P.C.

(57) ABSTRACT

A toy projectile that is intended to be thrown at a bristle target board. The toy projectile has a head section and a tail section. The head section of the toy projectile has a plurality of prongs that extend from a common circular base. The prongs have the same length, wherein the length of the prongs is generally equal to the diameter of the circular base. The prongs and the base are unistucturally molded together as a single piece. The common circular base of the head section is connected to the tail section in a manner that enables the common circular base and the prongs to rotate together relative to the tail section. The ability to rotate enables the prongs on the projectile to better penetrate a bristle target board and not bounce away, even when impact occurs at an angle.

16 Claims, 6 Drawing Sheets

TOY PROJECTILE HAVING IMPACT HEAD WITH MULTIPLE FLEXIBLE PRONGS

BACKGROUND OF THE INVENTION

1. Field of the Invention

In general, the present invention relates to novelty projectile toys, such as oversized darts, that include a head section with an extending tail section for stabilization during flight. More particularly, the present invention relates to the structure of the projectile toy and the features on the head section that impact a target.

2. Description of the Prior Art

There are many toy projectiles that are intended to be thrown or launched into flight. Many such projectiles have tail sections with fletching elements that stabilize the projectile in flight. In making a toy projectile that is intended for children, one of the most important concerns is safety. It is understood that although a toy projectile is intended to be thrown at a specific target, children will inevitably throw or launch the projectile at other objects, including other children. As such, the toy projectile must be light enough to prevent blunt force harm and soft enough to prevent impact harm.

In the toy industry, these goals are typically achieved by placing a large soft head on the projectile. The soft head is usually foam or a suction cup. The head of the projectile is too blunt to cause injury to the eyes, mouth, or other sensitive parts of the body. However, the use of a toy projectile with a large blunt head also prevents the toy projectile from penetrating any type of target. Consequently, if a toy projectile is designed to be used with a target, the target is typically smooth, and the toy projectile is provided with suction cups. This enables the toy projectile to stick to the target without having to penetrate the target.

Although a suction cup head on a toy projectile is generally safe, it does limit the design options for targets. There are many games, such as darts and archery, where penetration of a target adds to the play value of the game. In U.S. Pat. No. D931,372, a target board is disclosed that is made from plastic bristles. A variety of throwable projectiles are provided that have soft edges yet can penetrate the target board by passing between the plastic bristles. The projectiles provided are toy axes and similar projectiles with large soft edges that do not present any impact danger. However, the use of such large edged projectiles prevents the projectiles from being configured as an arrow or dart.

A need therefore exists for an improved toy projectile design that is safe for use with children, yet can be adapted to traditionally pointed projectiles, such as darts and arrows. A need also exists for such an improved projectile design that can penetrate and attach to a plastic bristle target board. These needs are met by the present invention as described and claimed below.

SUMMARY OF THE INVENTION

The present invention is a toy projectile that is intended to be thrown at a bristle target board. The toy projectile has a head section and a tail section. The tail section contains fletching elements to provide stable flight. The head section of the toy projectile has a plurality of prongs that extend from a common circular base. The prongs have the same length, wherein the length of the prongs is generally equal to the diameter of the circular base. The prongs and the base are unistucturally molded together as a single piece.

The common circular base of the head section is connected to the tail section in a manner that enables the common circular base and the prongs to rotate together relative to the tail section. The ability to rotate enables the prongs on the projectile to better penetrate a bristle target board and not bounce away, even when impact occurs at an angle.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention can be configured as many types of toy projectiles, such as toy arrows, the present invention is especially well suited for being configured as a hand-thrown projectile, such as a large toy dart. Accordingly, the present invention is illustrated and described as a toy dart in order to set forth one of the best modes contemplated for the invention. However, the illustrated embodiment is only intended to be exemplary and should not be considered as limiting other possible embodiments of the invention covered within the scope of the claims.

Figure 1:
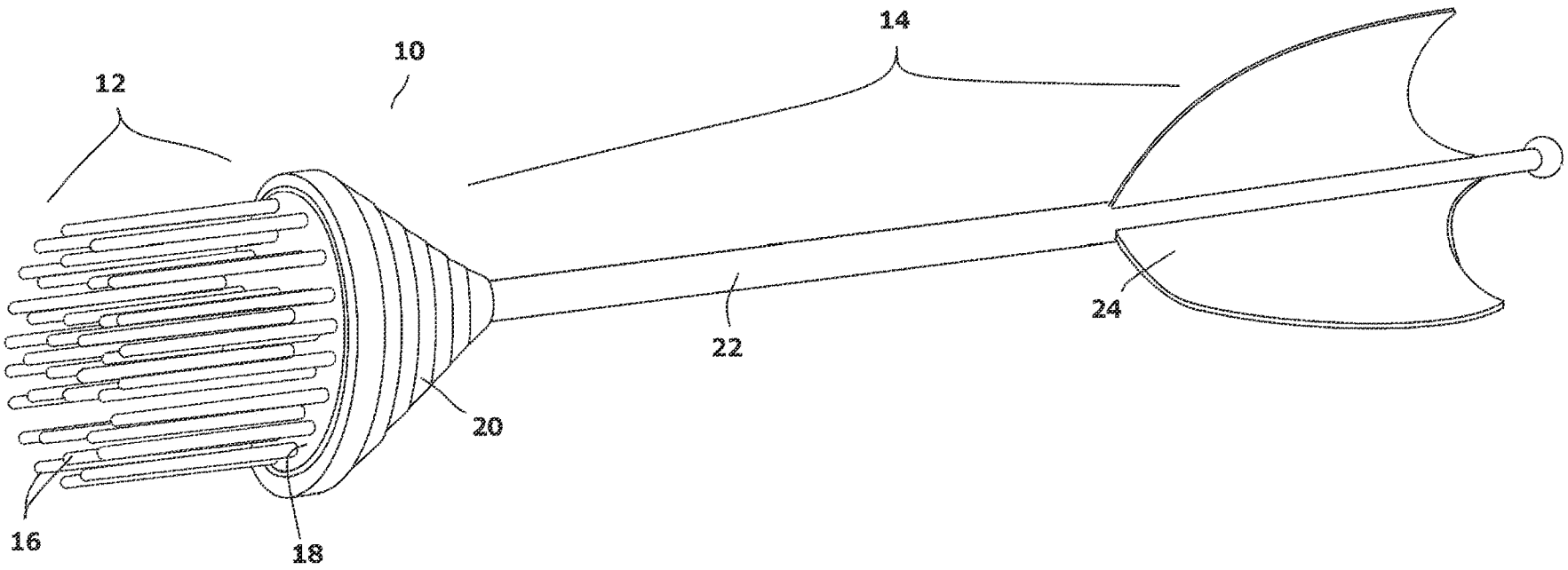
FIG. 1 is a front perspective view of an exemplary embodiment of a hand-thrown projectile.
Figure 2:
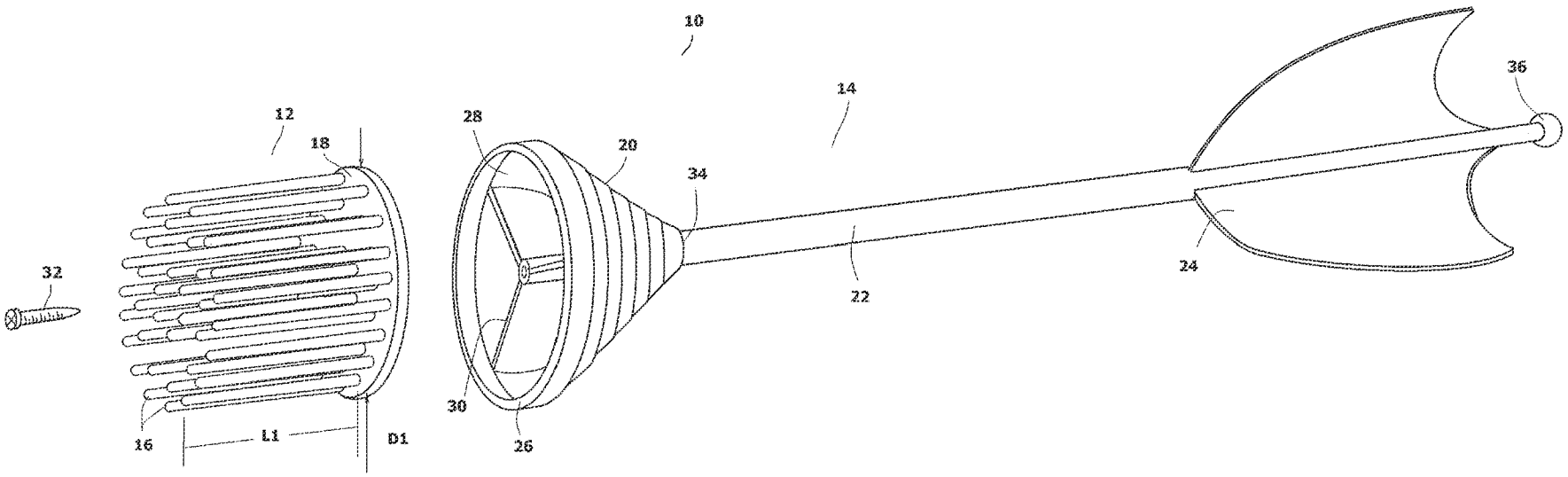
FIG. 2 is an exploded view of the embodiment of FIG. 1.

Referring to FIG. 1 in conjunction with FIG. 2, a toy projectile 10 is shown. The toy projectile 10 has a head section 12 and a tail section 14. The head section 12 contains a plurality of flexible prongs 16 that all extend in a common direction from a common circular base 18. The flexible prongs 16 are plastic and are arranged in a pattern that is later described. All the flexible prongs 16 have a common length L1. As such, all the flexible prongs 16 terminate in a common plane that is parallel to the circular base 18. The circular base 18 has a diameter D1. The length L1 of the flexible prongs 16 is generally equal to the diameter D1 of the circular base 18 plus/minus twenty percent, depending upon the number of flexible prongs 16.

The tail section 14 has a conical cup 20, a straight shaft 22, and fletching elements 24. The straight shaft 22 extends from the center of the conical cup 20. The fletching elements 24 radially extend from the straight shaft 22. The conical cup 20 has a wide end 26 of a first diameter. A recess 28 is formed in the wide end 26 of the conical cup 20 that is shaped and sized to receive the circular base 18 of the head section 12. Support ribs 30 are provided inside the conical cup 20 and below the recess 28. The support ribs 30 orient and support the circular base 18 of the head section 12 within the recess 28. A mechanical fastener 32 is used to affix the circular base 18 of the flexible prongs 16 to the wide end 26 of the conical cup 20, once the circular base 18 is in abutment with the support ribs 30. The sole mechanical fastener 32 passes through the center of the circular base 18 for a reason that is later explained.

The conical cup 20 tapers to a narrow end 34 of a much smaller diameter than the wide end 26. The narrow end 34 of the conical cup 20 extends into the straight shaft 22. The straight shaft 22 is slightly flexible due to its plastic construction. The straight shaft 22 can be uniform in diameter or can taper slightly as it extends away from the conical cup 20. The length of the straight shaft 22 is preferably between three times and four times the length of the flexible prongs 16. The straight shaft 22 terminates at a free end 36 opposite the conical cup 20. The fletching elements 24 radially extend from the straight shaft 22 just prior to the free end 36. Although three fletching elements 24 are illustrated, it should be understood that any number of fletching elements 24 can be provided in a symmetrical pattern around the straight shaft 22.

The conical cup 20, the straight shaft 22, and the fletching elements 24 are preferably all unistucturally molded from plastic as a single piece. Accordingly, the conical cup 20 cannot move independently of the straight shaft 22 and the fletching elements 24 cannot detach from the straight shaft 22. The circular base 18 sits in the recess 28 at the wide end 26 of the conical cup 20. The circular base 18 is connected to the conical cup 20 by a single mechanical fastener 32 that passes through the geometric center of the circular base 18. The circular base 18 is free to rotate about the mechanical fastener 32 in the recess. As such, the circular base 18, and the flexible prongs 16 that extend from the circular base 18, can rotate relative to the tail section 14 of the toy projectile 10. The importance of this feature is later explained.

Figure 3:
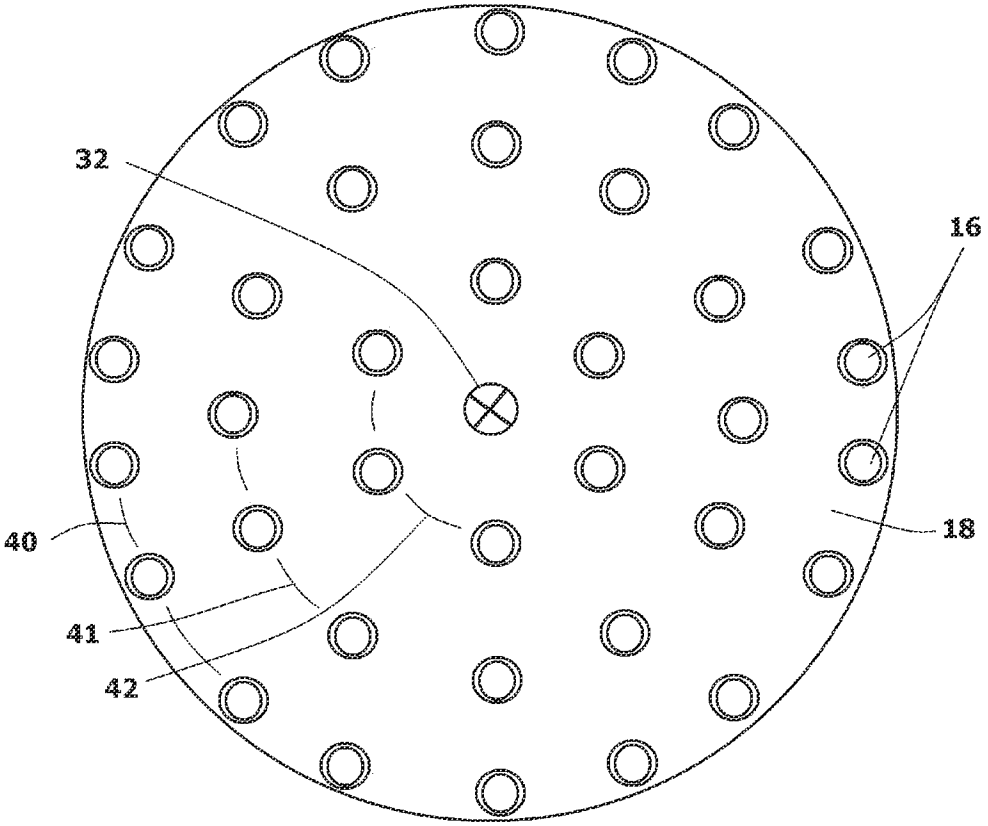
FIG. 3 is a front view of the head section of the exemplary embodiment.
Figure 4:
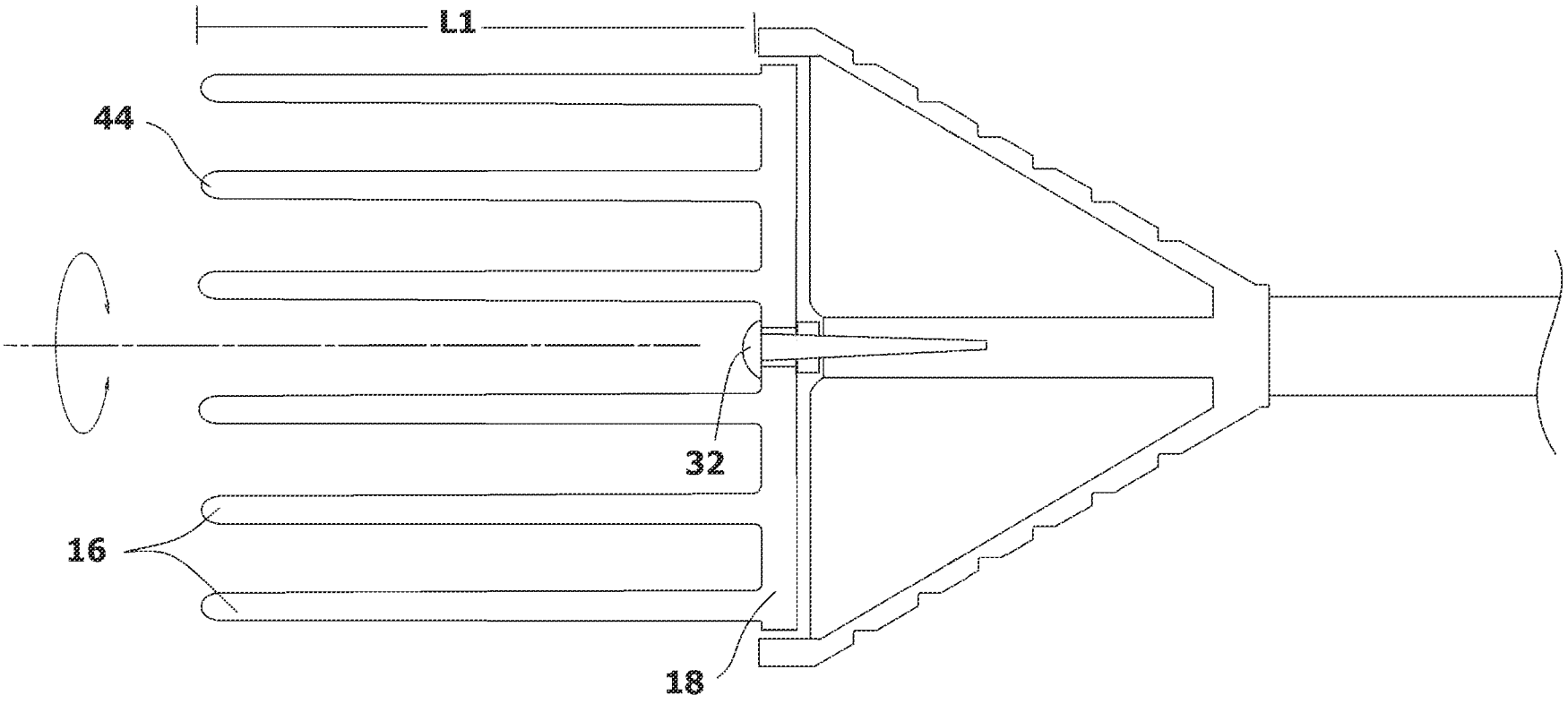
FIG. 4 is a cross-sectional view of the head section of the exemplary embodiment.

Referring to FIG. 3 and FIG. 4 in conjunction with FIG. 1 and FIG. 2, it can be seen that in the illustrated embodiment there are thirty-six flexible prongs 16 that are arranged in three concentric circular patterns 40, 41, 42. The flexible prongs 16 are spaced, wherein the closest distance between any two prongs 16 is between fifteen percent and thirty percent of the length L1 of the flexible prongs 16. The use of three concentric patterns 40, 41, 42 and thirty-six flexible prongs 16 is exemplary. Depending upon the size and mass of the toy projectile 10, more or fewer prongs and circular patterns can be used, provided there are at least four flexible prongs in one circular pattern. Each of the flexible prongs 16 has the same shape and length L1 as all the other flexible prongs 16. The flexible prongs 16 have a preferred length of between eight times and twelve times the average prong diameter. Each flexible prong 16 can also have a slight taper from tip to base to assist in removal from an injection molding machine. The flexible prongs 16 are unistucturally molded with the circular base 18. As such, the circular base 18 and the flexible prongs 16 are one piece and move together.

Figure 5:
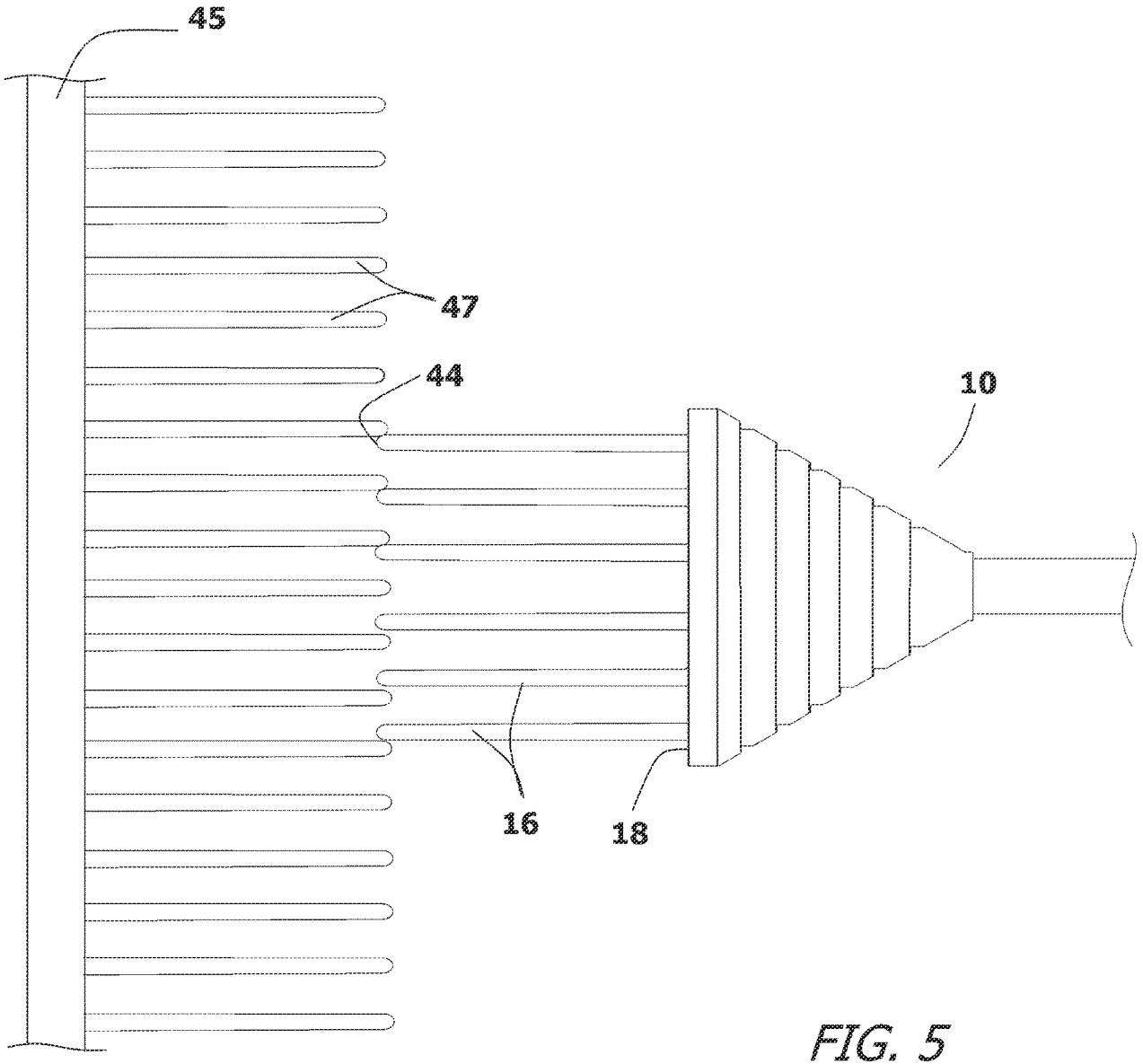
FIG. 5 shows the exemplary embodiment of the toy projectile engaging a bristle board target at a perpendicular.

Referring to FIG. 5 in conjunction with FIG. 4, it will be understood that the toy projectile 10 is intended to be thrown at a target surface 45 that is also covered in extending target prongs 47. Such a target surface 45 is disclosed in U.S. Pat. No. D931,372, the disclosure of which is herein incorporated by reference. Upon impact, the target prongs 47 on the target surface 45 and the flexible prongs 16 on the toy projectile 10 intermesh. Friction between the target prongs 47 and the flexible prongs 16 retain the toy projectile 10 in position on the target surface 45. Given the large number of target prongs 47 on the target surface 45 and the many flexible prongs 16 on the toy projectile 10, it is inevitable that a tip 44 of a flexible prong 16 will impact a target prong 47. To prevent rebound, the tips 44 of all the flexible prongs 16 are rounded. Furthermore, the flexible prongs 16 and circular base 18 have the ability to rotate relative to the tail section 14 of the toy projectile 10. As such, if the target prongs 47 and the flexible prongs 16 strike one another, the flexible prongs 16 will rotate and will pass next to the impacted target prongs 47. Friction will then retain the toy projectile 10 in place on the target surface 45.

Figure 6:
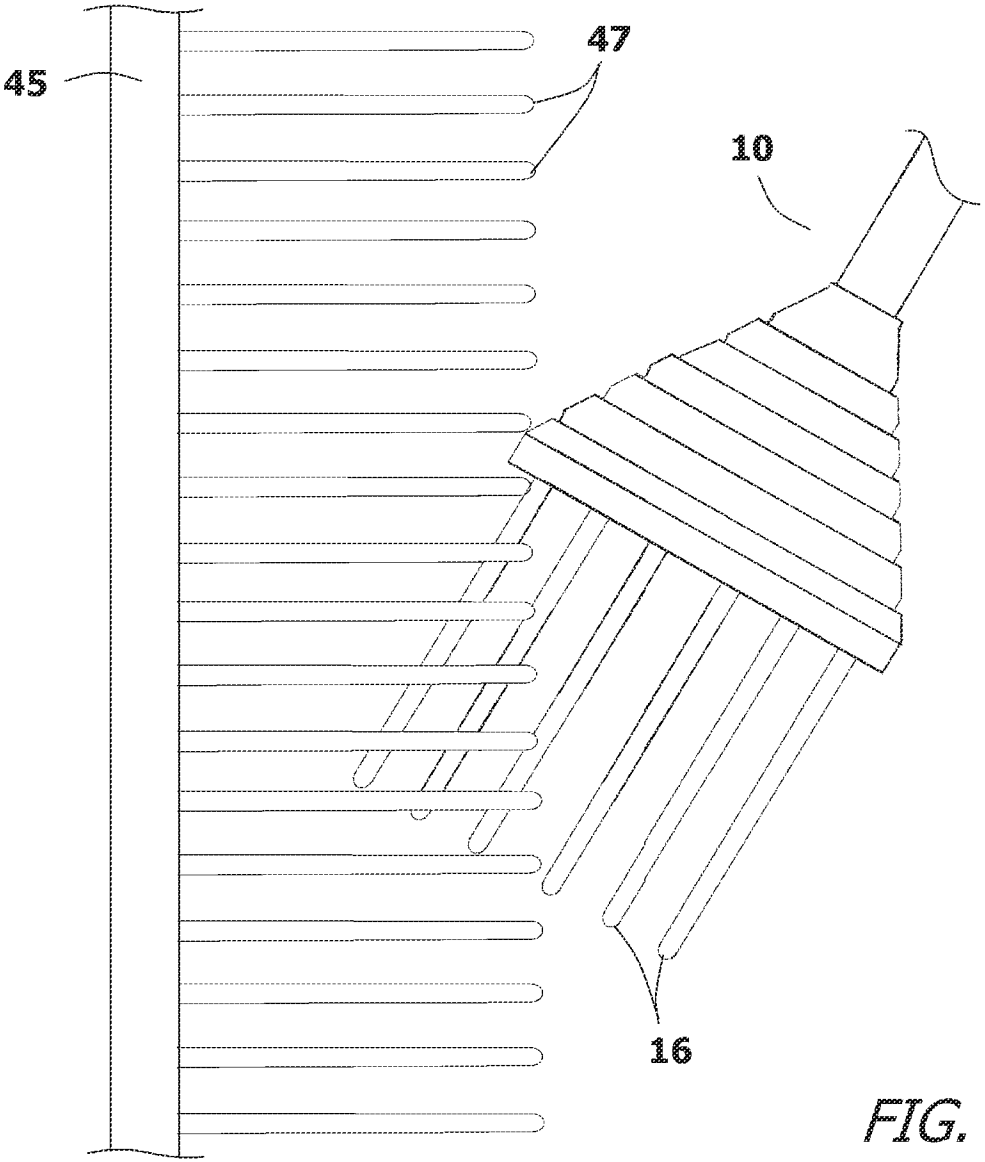
FIG. 6 shows the exemplary embodiment of the toy projectile engaging a bristle board at an inclined angle.

Referring to FIG. 6, it can be seen that due to the long length of the flexible prongs 16, the toy projectile 10 can still engage the target surface 45 even when the toy projectile 10 impacts the target surface 45 at a significant angle. The ability of the flexible prongs 16 to flex and the ability of the entire head section 12 to rotate combine to enable the flexible prongs 16 to pass around the target prongs 47 and intermesh with the target prongs 47. Friction will then retain the toy projectile 10 in place on the target surface 45.

It will be understood that the embodiment of the present invention that is illustrated and described is merely exemplary and that a person skilled in the art can make many alternate embodiments. For example, the toy projectile can have prongs that vary in number, position, and length. Furthermore, features such as the length of the shaft and the shape/number of fletching elements are a matter of design choice. All such variations, modifications and alternate embodiments are intended to be included within the scope of the present invention as defined by the claims.

What is claimed is:

1. A toy projectile comprising:

a head section having a plurality of prongs extending from a common base, wherein said plurality of prongs include at least four prongs arranged in at least one circular pattern on said common base; and a tail section having a shaft and fletching elements, wherein said common base of said head section is connected to said tail section, and wherein said common base is free to rotate relative to said tail section while connected to said tail section.

2. The toy projectile according to claim 1, wherein said shaft has a recessed structure at one end that receives said common base of said head section.

3. The toy projectile according to claim 1, wherein said plurality of prongs all extend a common length from said common base.

4. The toy projectile according to claim 3, wherein said shaft has a length that is no greater than eight times said common length of said plurality of prongs.

5. The toy projectile according to claim 1, wherein said common base has a maximum width and each of said plurality of prongs has a length that is equal to said maximum width plus/minus twenty percent.

6. The toy projectile according to claim 1, wherein said tail section terminates at one end with a cup structure that receives said common base therein.

7. The toy projectile according to claim 6, wherein said cup structure contains support ribs that support and orient said common base.

8. The toy projectile according to claim 1, wherein said plurality of prongs are arranged in a plurality of circular patterns that each contain at least six of said plurality of prongs.

9. A toy projectile comprising:

a circular base;

a plurality of prongs extending from said circular base in a common direction, wherein said circular base and said plurality of prongs are unistucturally molded as a single unit;

a cup structure that receives said circular base, wherein said circular base is free to rotate relative to said cup structure while connected to said cup structure;

a shaft that extends from said cup structure; and fletching elements that radially extend from said shaft.

10. The toy projectile according to claim 9, wherein said circular base has a center and a mechanical fastener that extends through said center, therein joining said circular base to said cup structure.

11. The toy projectile according to claim 9, wherein said plurality of prongs all extend at a common length from said circular base.

12. The toy projectile according to claim 9, wherein said cup structure contains ribs that support and orient said circular base within said cup structure.

13. The toy projectile according to claim 9, wherein said plurality of prongs are arranged in a plurality of circular patterns that each contain at least six of said plurality of prongs.

14. A toy projectile comprising:

a shaft having a cup structure at one end of said shaft;

a circular base coupled to said cup structure, wherein said circular base has a first diameter and wherein said circular base is free to rotate relative to said cup structure; and a plurality of prongs extending from said common base in a direction opposite of said shaft, wherein said plurality of prongs each have the same length, wherein said length is equal to said first diameter plus/minus twenty percent.

15. The toy projectile according to claim 14, wherein said plurality of prongs and said common base are unistucturally molded as one piece.

16. The toy projectile according to claim 14, wherein said plurality of prongs are arranged in a plurality of circular patterns.

* * * * *